US007273129B2

(12) United States Patent
Harwood

(10) Patent No.: US 7,273,129 B2
(45) Date of Patent: Sep. 25, 2007

(54) MUFFLER WITH INTERNAL HEAT SHIELD

(75) Inventor: Jon W. Harwood, Toledo, OH (US)

(73) Assignee: Faurecia Exhaust Systems, Inc., Toledo, OH (US)

( * ) Notice: Subject to any disclaimer, the term of this patent is extended or adjusted under 35 U.S.C. 154(b) by 314 days.

(21) Appl. No.: 10/849,596

(22) Filed: May 20, 2004

(65) Prior Publication Data

US 2005/0051383 A1 Mar. 10, 2005

Related U.S. Application Data

(60) Provisional application No. 60/500,500, filed on Sep. 5, 2003.

(51) Int. Cl.

| | |
|---|---|
| ***F01N 1/24*** | (2006.01) |
| ***F01N 1/10*** | (2006.01) |
| *F01N 1/00* | (2006.01) |
| *F01N 7/18* | (2006.01) |

(52) U.S. Cl. ..... 181/256; 181/252; 181/282

(58) Field of Classification Search ..... 181/256, 181/252, 282; 228/59

See application file for complete search history.

(56) References Cited

U.S. PATENT DOCUMENTS

| | | | | |
|---|---|---|---|---|
| 3,109,511 | A | 11/1963 | Slayter et al. | |
| 4,109,752 | A | 8/1978 | Ferralli | |
| 4,136,757 | A * | 1/1979 | Bauerschmidt | 181/256 |
| 4,137,993 | A * | 2/1979 | Rutt | 181/282 |
| 4,332,307 | A | 6/1982 | Ito | |
| 4,487,289 | A * | 12/1984 | Kicinski et al. | 181/252 |
| 4,550,799 | A | 11/1985 | Flugger | |
| 4,598,790 | A | 7/1986 | Uesugi et al. | |
| 4,619,344 | A * | 10/1986 | Uesugi et al. | 181/229 |
| 4,693,338 | A | 9/1987 | Clerc | |
| 4,736,817 | A * | 4/1988 | Harwood | 181/282 |
| 4,759,423 | A * | 7/1988 | Harwood et al. | 181/282 |
| 4,847,965 | A * | 7/1989 | Harwood et al. | 29/890.08 |
| 4,928,372 | A * | 5/1990 | Harwood et al. | 29/890.08 |
| 5,014,903 | A | 5/1991 | Cyb | |
| 5,036,585 | A | 8/1991 | Schweinfurth | |
| 5,116,581 | A | 5/1992 | Cyron et al. | |
| 5,168,132 | A * | 12/1992 | Beidl et al. | 181/265 |
| 5,206,467 | A | 4/1993 | Nagai et al. | |
| 5,321,214 | A * | 6/1994 | Uegane et al. | 181/211 |
| 5,340,952 | A | 8/1994 | Takiguchi | |
| 5,428,194 | A * | 6/1995 | Emrick et al. | 181/228 |
| 5,859,394 | A * | 1/1999 | Seehaus et al. | 181/282 |
| 5,892,186 | A * | 4/1999 | Flugger | 181/252 |
| 5,912,441 | A * | 6/1999 | Worner | 181/282 |
| 5,934,959 | A | 8/1999 | Inman, Sr. et al. | |
| 6,070,695 | A | 6/2000 | Ohtaka et al. | |
| 6,158,214 | A | 12/2000 | Kempka et al. | |
| 6,196,351 | B1 | 3/2001 | Clokey et al. | |
| 6,668,972 | B2 * | 12/2003 | Huff et al. | 181/256 |
| 6,789,644 | B2 * | 9/2004 | Mukaida | 181/272 |
| 2004/0003963 | A1 | 1/2004 | Worner et al. | |

FOREIGN PATENT DOCUMENTS

| | | | |
|---|---|---|---|
| FR | 2 819 550 | | 7/2002 |
| GB | 810368 | | 10/1957 |
| JP | 63109217 | A * | 5/1988 |
| JP | 02169812 | A * | 6/1990 |

* cited by examiner

*Primary Examiner*—Edgardo San Martin
(74) *Attorney, Agent, or Firm*—Gerald E. Hespos; Anthony J. Casella

(57) ABSTRACT

An exhaust muffler includes upper and lower external shells that are formed from metal material. A heat shield is disposed in the muffler adjacent the upper external shell. The heat shield is formed from a high-density fiber insulation pad configured to nest with the concave inner surface of the upper external shell.

16 Claims, 3 Drawing Sheets

MUFFLER WITH INTERNAL HEAT SHIELD

This application claims priority on U.S. Provisional Patent Appl. No. 60/500,500, filed Sep. 5, 2003.

BACKGROUND OF THE INVENTION

1. Field of the Invention

The invention relates to a heat-shielded vehicular exhaust muffler.

2. Description of the Related Art

The combustion that takes place in the engine of an automotive vehicle produces substantial amounts of heated noxious gas and significant amounts of noise. As a result, all automotive vehicles include an exhaust system that transports the exhaust gas from the engine to a location on the vehicle where the heat exhaust gas can be emitted safely. Additionally, the exhaust system includes components to convert certain of the noxious compounds in the exhaust gas into less noxious gases. Components of the exhaust system also function to attenuate the noise associated with the flowing and rapidly expanding gases produced by the combustion processes in the engine.

The typical exhaust system extends from the engine compartment near the front of the vehicle to a location at or near the rear of the vehicle where the exhaust gases may be emitted safely. The exhaust system includes a plurality of pipes, a catalytic converter and at least one muffler. These various components of the vehicle must compete for space on the underside of the vehicle with other necessary components of the vehicle. The muffler typically is the largest component of the exhaust system and hence is the most difficult to place on the vehicle. Stamp forming technology allows the designers of an exhaust system freedom to choose an appropriately configured muffler that can be nested into a space on the underside of the vehicle.

The entire exhaust system becomes very hot after a short period of operation due to the high temperatures generated during the combustion processes that produce the exhaust gas. The realities of designing an exhaust system to fit into the limited space on the underside of a vehicle typically positions certain components of the exhaust system close to passenger compartments, luggage compartments or other heat sensitive components or sections on the vehicle. As a result, most exhaust systems must include at least one heat shield, including a heat shield near the muffler.

The typical heat shield for a muffler is a thin sheet of metal that is stamped or otherwise formed to conform generally to the shape of the muffler. The heat shield may be formed with legs or other structures that provide small areas for attaching the heat shield to the muffler. However, a major portion of the typical heat shield is spaced from the outer shell of the muffler to provide an air gap that will insulate sensitive areas of the vehicle from the heated muffler. The heat shield typically is secured to the muffler by welding. However, other attachment means, such as straps, rivets or folded seams have been employed in the prior art.

Heat shields can be designed to perform their primary heat shielding function adequately. However, the metal of the heat shield adds to the cost and weight of the exhaust system. In this regard, automobile manufacturers exert substantial pressure on suppliers to reduce the size and weight of their products to enhance the fuel efficiency of the vehicle and to maximize space available for other components of the vehicle. Additionally, the automotive industry is extremely competitive and suppliers to the automotive industry are constantly looking for cost savings. Even small cost reductions can have a substantial commercial advantage.

The prior art heat shields also create the potential for maintenance problems. In particular, parts of the heat shield necessarily must be spaced from the muffler to perform the heat shielding function. As a result, the heat shield is substantially cooler than adjacent areas of the muffler. The temperature differential between the heat shield and the muffler leads to differential thermal expansion. Therefore, the weldments or other such attachments between the heat shield and the muffler are subject to substantial and repeated forces as the muffler goes through its heating and cooling cycles. Additionally, the entire exhaust system is subject to significant vibration during use. Consequently, the welded attachments between the heat shield and the muffler are subject to failure. A failed connection will cause the heat shield to vibrate against the exterior of the muffler and/or against other nearby parts of the vehicle. Such vibrations can create very objectionable noise. A folded connection between the heat shield and the muffler can be designed to accommodate some motion during differential thermal expansion without adversely affecting the long term connection between the muffler and the heat shield. However, folds or other such mechanical connections also are subject to vibration during use and hence can generate objectionable noise.

The muffler of an exhaust system includes an outer shell with at least one inlet that connects to an exhaust pipe and at least one outlet that connects to a tail pipe. The interior of the muffler includes an array of tubes and/or baffles that are designed to permit a controlled expansion of the exhaust gas in a manner that will attenuate the noise associated with the flowing exhaust gas. Some mufflers include conventional tubular pipes that are supported by transverse baffles in the muffler. The baffles define chambers within the muffler and the pipes are disposed to provide communication from one chamber to another. Other mufflers include stamp formed internal plates to define the exhaust gas channels and baffles within the muffler. Some chambers within some mufflers are filled with a loose array of fibers, such as fiberglass or E-glass. The array of fibers fill the chambers, but are sufficiently loosely arrayed to permit the exhaust gas to expand in the chamber and flow through the array of fibers. The array of fibers contributes to the noise attenuation function of the internal tubes and chambers of the muffler.

In view of the above, it is an object of the subject invention to provide a muffler to achieve effective heat shielding without the above-described problems associated with external mounted metallic heat shields.

It is another object of the subject invention to provide a heat shielded muffler without the cost, size and weight penalties associated with an externally disposed metal member.

An additional object of the subject invention is to provide a heat shielding arrangement for a muffler that is not likely to create vibration related noise.

SUMMARY OF THE INVENTION

The invention relates to an exhaust muffler with an outer shell that has inner and outer surfaces. The muffler includes a heat shield formed from a single layer of high-density fiber insulation pad disposed to cover at least part of the inner surface of the shell. The insulation pad can be made of a continuous or non-continuous fiberglass fiber, ceramic fiber or any other type of fiber that exhibits heat insulating properties. The insulation pad can be preformed to substantially conform to at least part of the shape defined by the internal surface of the outer shell of the muffler. In other embodiments, the insulation pad can be formed in-situ.

The insulation pad may be laminated with a thin layer of metallic foil. The metallic foil preferably is formed from a material that will withstand exposure to the environment in the muffler. The foil may be disposed on a side of the insulation pad facing the outer shell of the muffler or on the side facing into the muffler.

The muffler may further include an array of noise insulation packing, such as an array of fiberglass or E-glass. The fiberglass or E-glass packing performs a known noise insulation function. However, the density of the fiberglass or E-glass packing for performing the noise insulating function prevents the packing from performing a significant heat insulating function. Thus, the noise insulating fiberglass or E-glass packing is functionally and structurally separate from the heat shielding insulation pad. Additionally, the packing may perform a function of holding the heat shielding insulation pad in position.

The muffler may be manufactured at least partly from stamp formed components. In particular, the muffler may comprise first and second outer shells each of which has a peripheral flange and at least one chamber extending from the peripheral flange. The peripheral flanges of the first and second outer shells may be dimensioned and configured to register with one another. The first outer shell may be an upper outer shell disposed to nest in a selected space on the underside of the vehicle. The heat shielding high-density fiber insulation pad may be disposed to nest with the inner surface of the upper outer shell, and hence functions to shield adjacent areas of the vehicle from heat generated by the muffler.

The muffler may further include at least one internal plate formed with an array of channels and/or apertures. The channels and/or apertures function to guide exhaust gas through the muffler. The noise insulating E-glass packing may be disposed between the internal plate of the muffler and the heat shielding layer of high-density fiber insulation pad.

The heat shielding high-density fiber insulation pad is substantially less expensive than a conventional metallic heat shield mounted externally on a muffler. Additionally, the high-density fiber insulation pad weighs significantly less than a conventional metallic heat shield disposed externally on the muffler. Furthermore, the internally disposed high-density fiber insulation pad does not create the above-described problems relating to differential thermal expansion and vibration related noise in the event of a failure of a connection point due to differential thermal expansion.

DETAILED DESCRIPTION OF THE PREFERRED EMBODIMENTS

Figure 1:
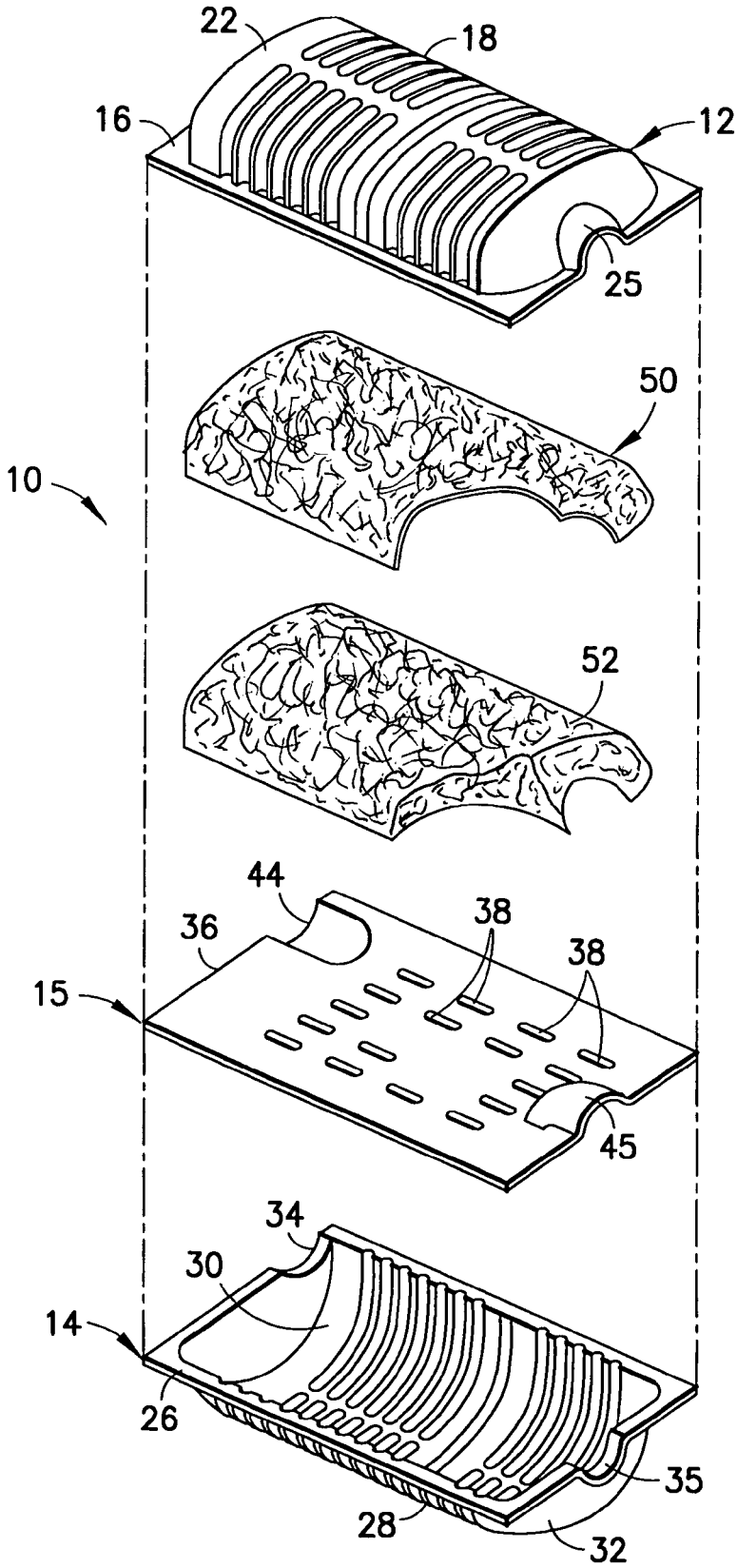
FIG. 1 is an exploded perspective view of a muffler in accordance with the subject invention.
Figure 2:
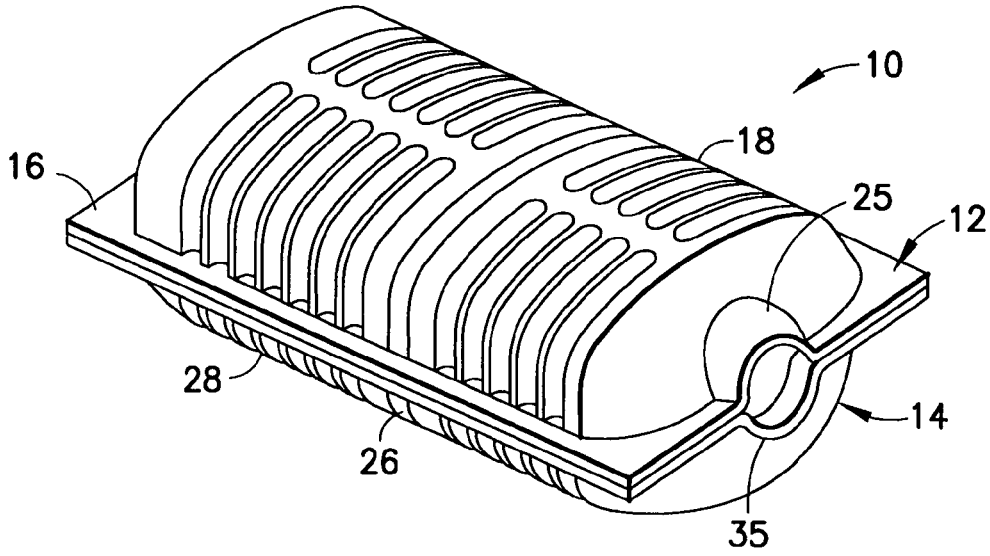
FIG. 2 is a perspective view of the assembled muffler.
Figure 3:
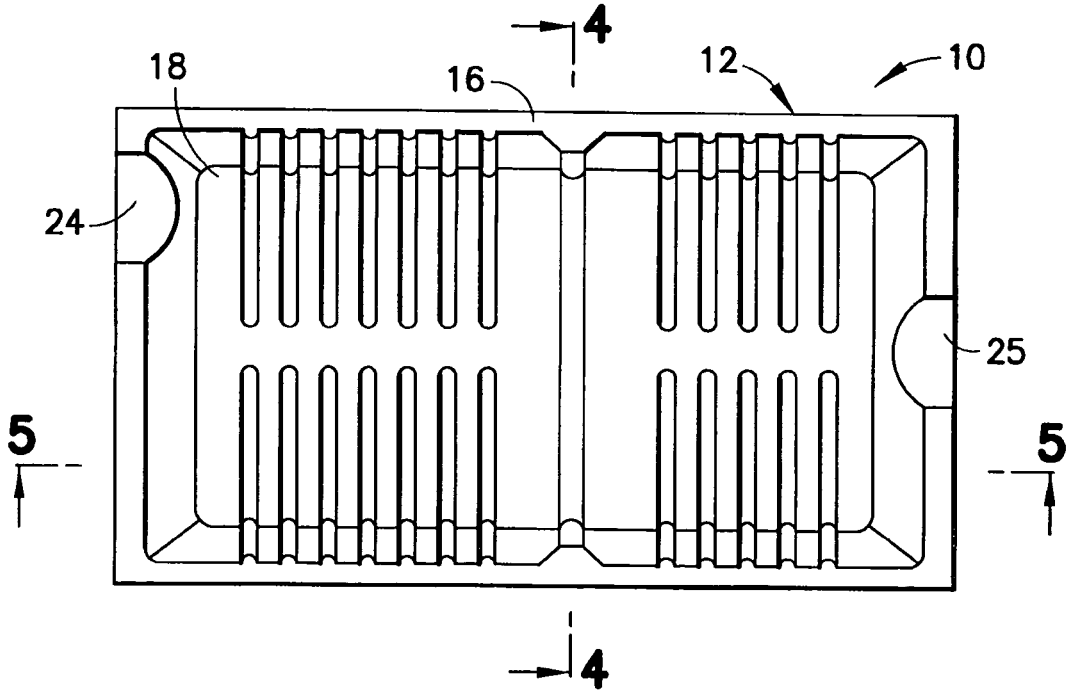
FIG. 3 is a top plan view of the muffler.
Figure 4:
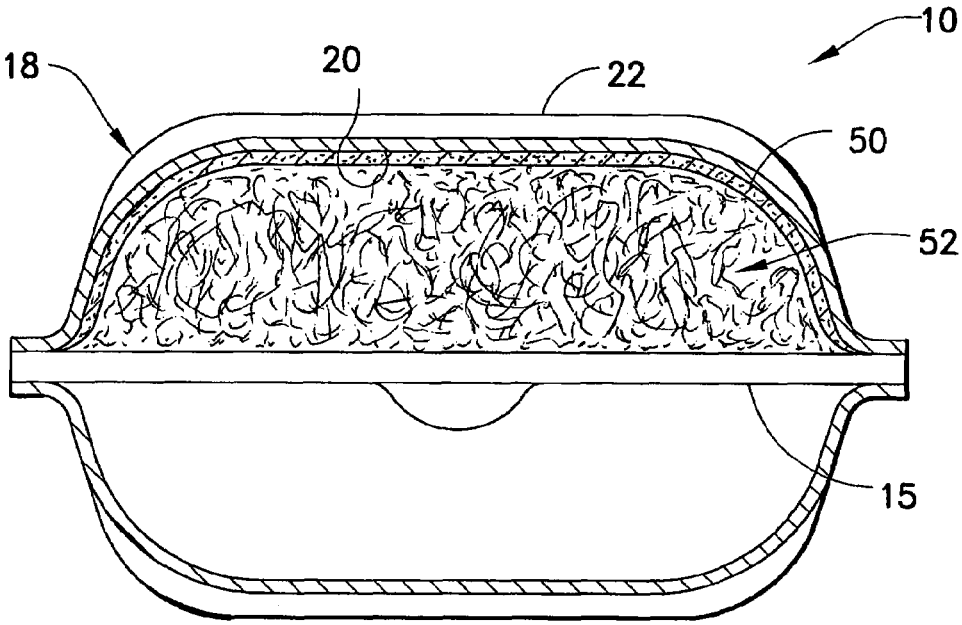
FIG. 4 is a cross-sectional view taken along line 4-4 in FIG. 3.
Figure 5:
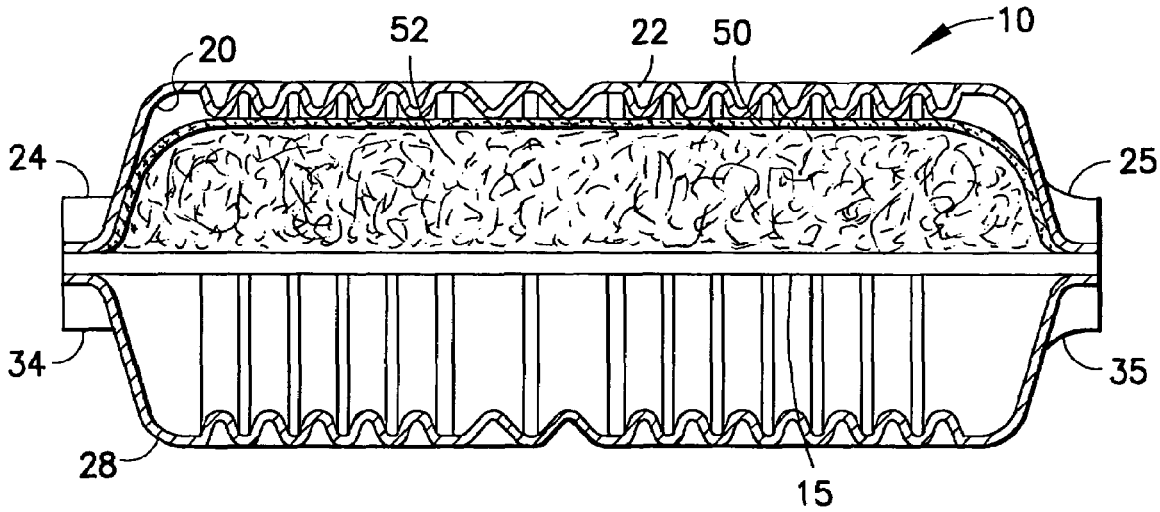
FIG. 5 is a cross-sectional view taken along line 5-5 in FIG. 3.

A muffler in accordance with the subject invention is identified generally by the numeral 10 in FIGS. 1 through 5. The muffler 10 includes upper and lower external shells 12 and 14 and an internal plate 15 that are stamped or otherwise formed from a metallic material. The upper external shell 12 includes a generally planar peripheral flange 16 and a chamber 18 extending upwardly and out of the plane defined by the peripheral flange. The upper external shell 12 includes a generally concave inner surface 20 and a generally convex outer surface 22. Additionally, the upper external shell 12 includes an inlet channel 24 and an outlet channel 25 each of which extends from the peripheral flange 16 into communication with the concave inner surface 20 of chamber 18.

The lower external shell 14 includes a planar peripheral flange 26 and a chamber 28 extending downwardly and out of the plane defined by the peripheral flange 26. The chamber 28 defines a concave inner surface 30 and a convex outer surface 32. The lower external shell 14 is further characterized by an inlet channel 34 and an outlet channel 35 that provide communication to the concave inner surface 30 defined by the chamber 28.

The upper and lower external shells 12 and 14 are configured so that the peripheral flanges 16 and 26 thereof can be registered with one another. Additionally, the inlet channels 24 and 34 and the outlet channels 25 and 35 register with one another when the peripheral flanges 16 and 26 are registered. Thus, the registered inlet channels 24 and 34 can be secured to an exhaust pipe (not shown) to provide exhaust gas communication to the interior of the muffler 10. Similarly, the registered outlet channels 25 and 35 can be secured to a tail pipe (not shown) to provide exhaust gas communication from the interior of the muffler 10. The configuration of the upper and lower external shells 12 and 14 can take any form, and is not limited to the generally rectangular form shown in the figures.

The internal plate 15 includes an outer periphery 36 dimensioned and disposed to substantially register with the peripheral flanges 16 and 26 of the upper and lower external shells 12 and 14. Portions of the internal plate 15 internally of the outer periphery 36 are formed with an array of louvers 38 that provide communication from one side of the internal plate 15 to the other. The internal plate 15 further includes an inlet channel 44 and an outlet channel 45. The inlet channel 44 is disposed and configured to nest with the inlet channel 34 of the lower external shell 14. The outlet channel 45 is disposed and configured to nest with the outlet channel 25 of the upper external shell 12. With this design, the peripheral flanges 16 and 26 can be securely fixed to one another by laser welding or the like on opposite sides of the internal plate 15 so that the periphery 36 of the internal plate 15 is effectively sandwiched between the peripheral flanges 16 and 26 of the upper and lower external shells 12 and 14.

With this particular design, an inlet to the muffler 10 is defined between the inlet channel 44 of the internal plate 15 and the inlet channel 24 of the upper external shell 12. An outlet from the muffler 10 is defined between the outlet channel 45 of the internal plate 15 and the outlet channel 35 of the lower external shell 14. With this particular design, exhaust gas initially will be channeled into a portion of the muffler 10 between the internal plate 15 and the upper external 12. The exhaust gas then will flow through the louvers 38 and will expand into the chamber defined between the internal plate 15 and the lower external shell 14.

The exhaust gas then will exit the muffler 10 through the outlet defined between the outlet channel 35 of the lower external shell 14 and the outlet channel 45 of the internal plate 15. Other configurations are possible. For example, the prior art is replete with examples of mufflers that have upper and lower plates that are secured in face-to-face engagement with one another and between the peripheral flanges 16 and 26 of the upper and lower external shells 12 and 14. These upper and lower internal plates are formed with arrays of channels and apertures to provide a selected exhaust gas flow pattern between the inlet and outlet of the muffler. The pattern of exhaust gas flow is selected in accordance with acoustical characteristics of the engine, the size and shape of the muffler and many other design factors. Additionally, a portion of the exhaust pipe or tail pipe may extend into the muffler to contribute to the selected flow pattern achieved in cooperation with one or more internal plates. The flow pattern and the configuration of the internal plate is not critical to the subject invention and is not described in further detail herein.

The muffler 10 further includes a heat shield 50 formed from a high-density fiber insulation pad configured to nest with the concave inner surface 20 of the upper external shell 12. The pad may be formed from a continuous or non-continuous fiberglass, ceramic fiber or other type of fibrous insulating material that is compressed under heat and pressure into a shape substantially conforming to the shape defined by the chamber 18 of the upper external shell 12. The heat shield 50 may further include a thin layer of stainless steel foil adhered to at least one surface of the heat shield 50. The heat shield 50 preferably is compressed to define a density in the range of about 5-11 pounds per cubic foot. The thickness of the heat shield may vary from one application to the next, but typically will be in a range of ¼-⅝ inch.

The muffler 10 may further include an array of E-glass packing 52 disposed between the internal plate 15 and the heat shield 50. The packing 52 is provided only in those situations where such packing is needed for acoustical purposes, and may not be an essential part of all mufflers 10. The packing 52 need not be formed from the same material as the heat shield 50 and typically will be much less dense than the heat shield 50. For example, the packing may have a density in the range of 80-120 grams per liter.

The heat shield 50 provides very effective heat insulation between the upper external shell 12 and adjacent parts of an automotive vehicle. Additionally, the heat shield 50 is much less costly and much lighter weight than a conventional metallic heat shield mounted externally on a muffler. Still further, the heat shield 50 does not pose attachment problems related to differential thermal expansion comparable to the attachment problems of conventional externally mounted heat shields. Thus, there is no probability of vibration-related noise attributable to the heat shield 50.

What is claimed is:

1. A heat shielded muffler comprising:

a first external shell stamp formed from a metallic material and having a peripheral flange and a chamber projecting from the peripheral flange, the chamber defining a concave inner surface;

a second external shell stamped form from a metallic material and having a peripheral flange secured to the peripheral flange of the first external shell, the external shells being formed to define at least one inlet to the muffler and at least one outlet from the muffler;

a heat shield comprised of a fibrous insulating material compressed to a density in a ranged of 5-11 pounds per cubic foot and configured to conform to the concave inner surface of the first external shell, portions of the second external shell spaced from the peripheral flange thereof having no heat shield adjacent thereto; and a sound insulation material disposed in the muffler adjacent the heat shield, the sound insulation material being formed to be less dense than the heat shield.

2. The muffler of claim 1, wherein the heat shield is formed from continuous fibers.

3. The muffler of claim 1, wherein the heat shield is formed from non-continuous fibers.

4. The muffler of claim 1, wherein the heat shield is formed from fiberglass fibers.

5. The muffler of claim 1, wherein the heat shield is formed from ceramic fibers.

6. The muffler of claim 1 wherein the sound insulation material is formed from E-glass.

7. The muffler of claim 1 wherein the sound insulation material has a density in the range of 90-120 grams per liter.

8. The muffler of claim 7, further comprising at least one internal plate between the external shells, the sound insulation material substantially filling a volume of the muffler defined between the internal plate and the heat shield.

9. The muffler of claim 1 wherein the heat shield has a thickness of ¼-⅝ inch.

10. The muffler of claim 1, wherein the heat shield further comprises at least one layer of metal foil secured to at least one surface of the high-density fiber of the heat shield.

11. The muffler of claim 1, wherein the second external shell defines a chamber inwardly of the peripheral flange, the chamber of the second external shell having a concave inner surface.

12. The muffler of claim 11, further comprising at least one internal component defining a gas communication pattern between the inlet and the outlet.

13. A method for forming a heat shielded muffler comprising:

stamp-forming a metallic first external shell having a peripheral flange and a concave surface inward from the peripheral flange;

placing loose fibrous insulating material adjacent the concave surface of the first external shell;

compressing the loose fibrous insulating material in situ under heat and pressure against the concave surface of the metallic first external shell to form a compressed fibrous mat nested adjacent the concave surface of the metallic first external shell to define a heat shield;

placing at least one metallic internal plate substantially in registration with the peripheral flange of the metallic first external shell to define a first chamber between the internal plate and the heat shield; and securing a metallic second external shell to peripheral regions of the metallic internal plate and to the peripheral flange of the metallic first external shell to define a second chamber between the metallic internal plate and the metallic second external shell.

14. The method of claim 13, further comprising securing at least one layer of metal foil to at least one surface of said heat shield.

15. The method of claim 13, further comprising disposing an array of sound insulation fibers in said chamber and substantially adjacent said heat shield.

16. A method for forming a heat shield muffler comprising;

stamp-forming a first external shell having a peripheral flange and a concave surface inward from the peripheral flange;

compressing a loose array of fibers into a compressed fibrous mat conforming to a shape defined by the concave surface of the first external shell, the compressed fibrous mat having a density of about 5-11 pounds per cubic foot and a thickness of about ¼-⅝ inch:

nesting the compressed fibrous mat adjacent the concave surface of the first external shell to define a heat shield;

placing at least one metallic internal plate substantially in registration with the peripheral flange of the first external shell to define a first chamber between the internal plate and the heat shield; and securing a metallic second external shell to peripheral regions of the internal plate and to the peripheral flange of the first external shell to define a second chamber between the internal plate and the second external shell.

* * * * *